US008443850B2

(12) United States Patent
Sollner et al.

(10) Patent No.: US 8,443,850 B2
(45) Date of Patent: May 21, 2013

(54) FILLING DEVICE

(75) Inventors: Jurgen Sollner, Beratzhausen (DE); Holger Muller, Regensburg (DE); Markus Riedl, Schwandorf (DE)

(73) Assignee: Krones AG, Neutraubling (DE)

( * ) Notice: Subject to any disclaimer, the term of this patent is extended or adjusted under 35 U.S.C. 154(b) by 376 days.

(21) Appl. No.: 12/690,190

(22) Filed: Jan. 20, 2010

(65) Prior Publication Data

US 2010/0193072 A1 Aug. 5, 2010

(30) Foreign Application Priority Data

Jan. 30, 2009 (DE) ..... 10 2009 006 795

(51) Int. Cl.
*B65B 1/20* (2006.01)

(52) U.S. Cl.
USPC ..... 141/82; 222/146.1

(58) Field of Classification Search
USPC ..... 141/82; 222/146.1–146.6; 239/132, 239/132.1, 132.3
See application file for complete search history.

(56) References Cited

U.S. PATENT DOCUMENTS

| | | | | |
|---|---|---|---|---|
| 2,054,494 | A | 9/1936 | Bruce | |
| 3,138,178 | A | 6/1964 | Martin | |
| 3,831,644 | A | 8/1974 | Berg et al. | |
| 4,495,974 | A | 1/1985 | Pohorski | |
| 6,176,277 | B1 * | 1/2001 | Mayer | 141/82 |
| 6,669,106 | B2 * | 12/2003 | Delcea | 239/79 |
| 2006/0124765 | A1 * | 6/2006 | Kothen et al. | 239/125 |

FOREIGN PATENT DOCUMENTS

| | | | |
|---|---|---|---|
| DE | 19901355 | A1 | 7/2000 |
| DE | 20105716 | U1 | 5/2002 |
| JP | 2005014921 | A | 1/2005 |
| JP | 2006182407 | A | 7/2006 |

OTHER PUBLICATIONS

German Search Report 102009006795.7, Jan. 30, 2009.
Chinese Office Action for 201010001841.6 dated Dec. 5, 2011.

* cited by examiner

*Primary Examiner* — Jason K Niesz
(74) *Attorney, Agent, or Firm* — Marshall, Gerstein & Borun LLP

(57) ABSTRACT

A filling device for beverages includes a store tank for receiving a beverage supply, and a filling valve for filling packages with the beverage from the store tank. To reduce idle times in this filling device, a heat exchanger is integrated into the store tank and/or into the filling valve.

12 Claims, 3 Drawing Sheets

FILLING DEVICE

CROSS-REFERENCE TO RELATED APPLICATION

The present application claims the benefit of priority of German Patent Application No. 102009006795.7, filed Jan. 30, 2009. The entire text of the priority application is incorporated herein by reference in its entirety.

FIELD OF THE DISCLOSURE

The disclosure relates to a filling device for beverages, such as used in beverage bottling operations

BACKGROUND

Such a filling device is known from DE 20 105 716 U1. The known filling device is embodied in the form of a filler carousel comprising a carrier rotating about a vertical axis of revolution at the outer periphery of which a plurality of filling valves are disposed, which are arranged above supports for packages, such as for example bottles, and fill them with a product. The filling valves are supplied with the product via a store tank located on the carrier of the carousel and rotating along with it about the axis of revolution. The filling device furthermore contains a product circuit which permits, for example in case of a standstill of the machine, to circulate the product that cannot be filled into the packages until filling is possible again. A heat exchanger for the product is arranged in this product circuit which prevents the product from cooling in case of hot filling of the product. Such filling devices must be cleaned and sterilized at the latest when a product is changed. This is accomplished e.g. by steam and/or hot water. If the same is passed through the plant, the plant parts connected thereto are heated. As it is often not desired or even harmful for the product to come into contact with the plant parts heated to sterilization temperature, the complete filling device has to cool down before it is put into operation again. Thereby, time required for sterilizing during which a filling and package plant, of which the filling device is a component, is also forced to a standstill, is increased. In such a plant, further machines for the container manufacture and container treatment (stretch blow machines, sterilizing apparatuses, rinsers, etc.) can be provided upstream of the filling device with respect to the container transport direction, and container treatment machines, such as seamers, inspection machines, labeling machines, transporters, packing and palletizing machines, can be provided downstream thereof.

SUMMARY OF THE DISCLOSURE

An aspect underlying the disclosure is to provide a filling device in which nonproductive times are reduced.

By the embodiment according to the disclosure, the store tank and/or the filling valve can be quickly brought to and held at the required temperature, respectively. Thus, for example the store tank and/or the filling valve can be quickly cooled down to the operating temperature after sterilization, so that anew filling operation can be started immediately. In case of a production stop, it is for example possible to keep the store tank and/or the filling valve and thus the product contained therein at the operating temperature, so that immediately after the removal of the malfunction, filling can be continued without having to pass the product in a circuit and through an external heat exchanger beforehand.

Preferably, the heat exchanger is integrated in the walls of the store tank and/or the filling valve as there the highest efficiency in cooling or heating these plant components can be expected.

In the store tank, a double-walled embodiment is preferred, wherein a heat transfer medium flows between an internal and an external wall. In the process, the store tank can preferably have a double-walled design at all sides. To provide the heat transfer medium at the required temperature, the store tank is connected to a cooling and/or heating set.

If the filling device includes a filling carousel, the store tank is preferably disposed on the carousel approximately symmetrically to the axis of revolution and rotates along with the same. This has the advantage that thereby no constructively complex rotary distributors have to be provided which distribute the product to the filling valves.

The at least one cooling and/or heating set should be arranged as close as possible to the store tank and is preferably located on the same. Of course, the filling device according to the disclosure can also be operated with at least one cooling and/or heating set which stands close to the filling device and is connected thereto via corresponding medium supplies and rotary distributors.

If the filling device includes a filling carousel, the cooling and/or heating set should be arranged symmetrically to the axis of revolution of the filling carousel.

A channel integrated in the wall of the filling valve through which a heat transfer medium flows is a particularly effective heat exchanger by means of which the filling valve can be brought to or held at the operating temperature.

Preferably, the heat exchanger of the filling valve is supplied by the cooling and/or heating set which also supplies the store tank.

The channel of the heat exchanger of the filling valve should preferably extend over the complete height of a product chamber of the filling valve.

The filling device according to the disclosure is not limited by the employed filling method. Thus, it can be employed e.g. as a weighing filling device, a volumetric filling device with flow meter, a probe filling device, etc.

BRIEF DESCRIPTION OF THE DRAWINGS

In the following, one embodiment of the disclosure is illustrated more in detail with reference to the drawings. In the drawings.

DETAILED DESCRIPTION OF THE PREFERRED EMBODIMENT

Figure 1:
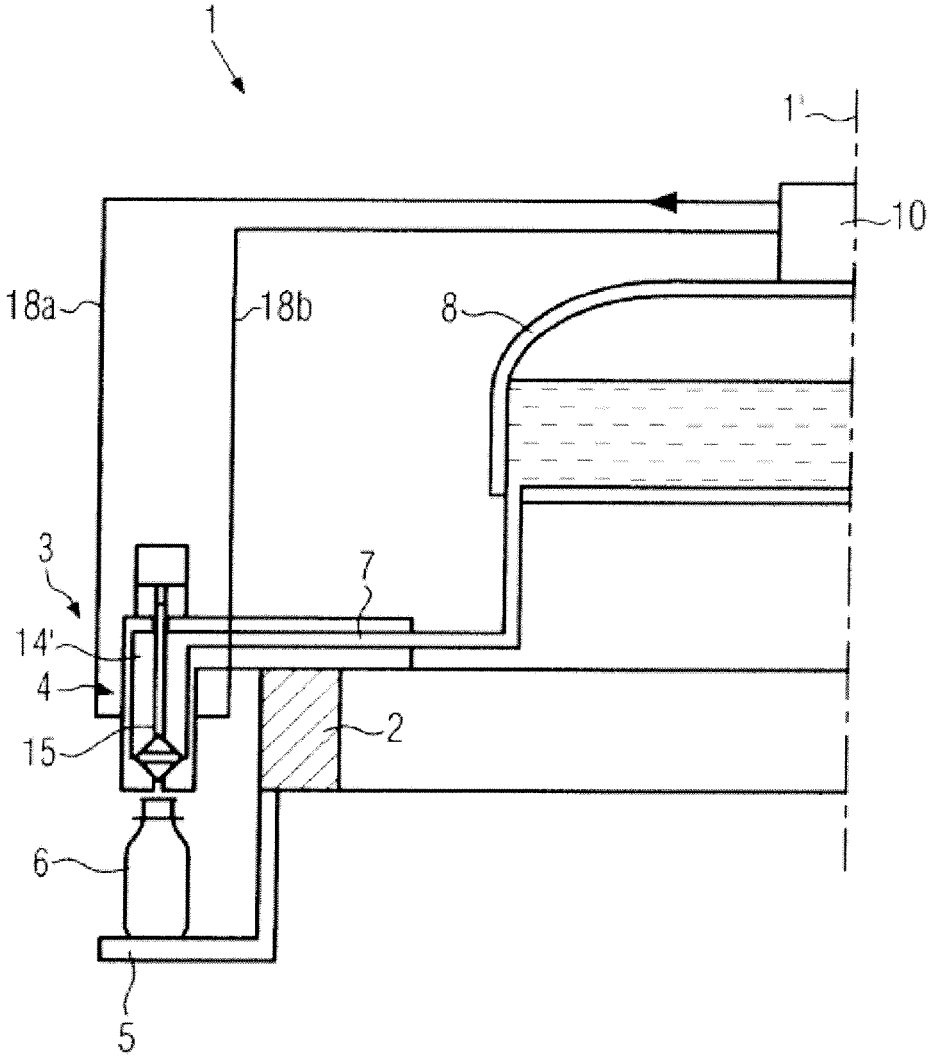
FIG. 1 shows a schematic representation of a filling device according to the disclosure.

FIG. 1 shows a filling device 1 in a highly schematized sectional representation which is embodied as a filling carousel in the represented embodiment. The filling device 1 includes a carrier 2 which rotates about an essentially perpendicular axis of revolution 1'. At or near the outer periphery of the carrier 2, a plurality of filling places 3 are arranged of which each comprises a filling valve 4 and a support 5 for the package 6 to be filled, wherein the support 5 is here embodied as a floor space and the package 6 as a bottle. The filling valve 4 is supplied with a product, i.e. for example with a liquid beverage, via a supply line 7 from a store tank 8. The store tank 8 is embodied in the form of a kettle and here arranged on the carrier 2 such that it can rotate about the axis of revolution 1' together with the carrier 2. The store tank 8, however, can also be designed to be stationary and be connected to each of the filling valves 4 via rotary distributors.

Figure 2:
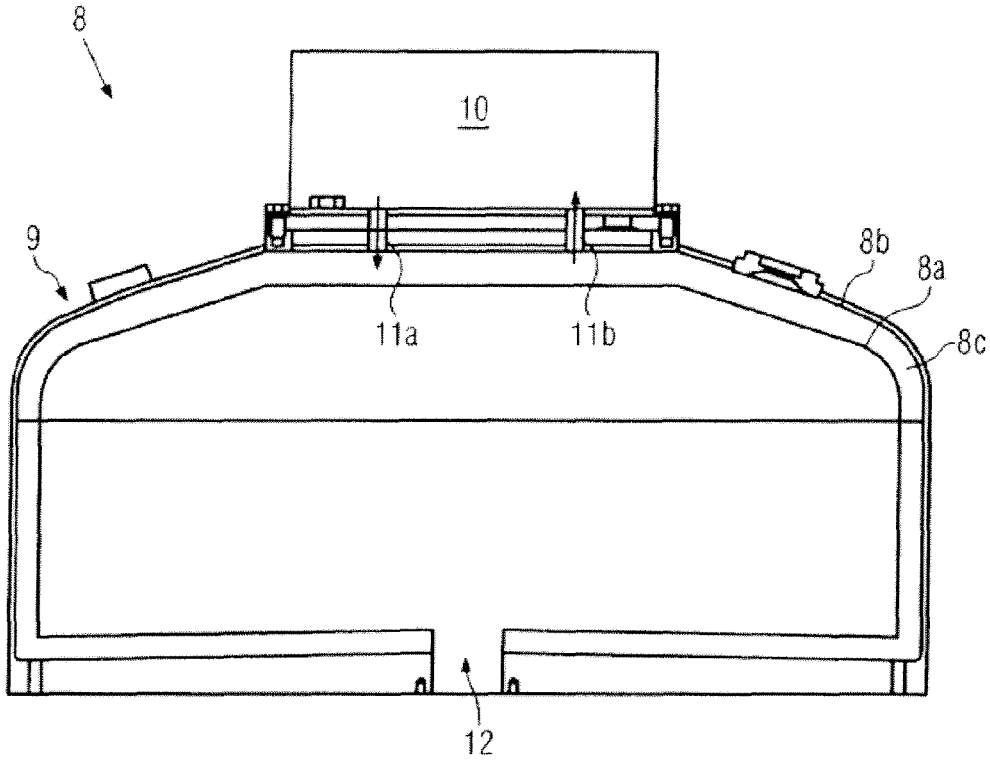
FIG. 2 shows a schematic representation of a store tank according to the disclosure.

A heat exchanger 9 is integrated in the store tank 8 as shown in FIG. 2. In the represented embodiment, the heat exchanger 9 is embodied as a double wall of the store tank with an internal wall 8*a*, an external wall 8*b* and a space 8*c* between the internal and external walls, wherein a heat transfer medium flows through the space 8*c*. In the represented embodiment, essentially all walls of the store tank 8 have a double-walled design, so that all portions of the store tank can be brought essentially simultaneously to the required temperature.

To bring the heat transfer medium to the required temperature, a cooling and/or heating set 10 is provided. The set 10 is preferably located on the top of the store tank 8, symmetrically to the axis of revolution 1', and rotates along with the same about the axis of revolution 1'. The set is in communication with the space 8*c* between the two walls 8*a*, 8*b* of the store tank 8 via flow and return pipes 11*a*, 11*b*.

Furthermore, the store tank 8 includes an inlet line 12 for a sterilization medium, for example steam, and includes the non-depicted supply points for the supply line 7 to the individual filling valves 4.

Figure 3A:
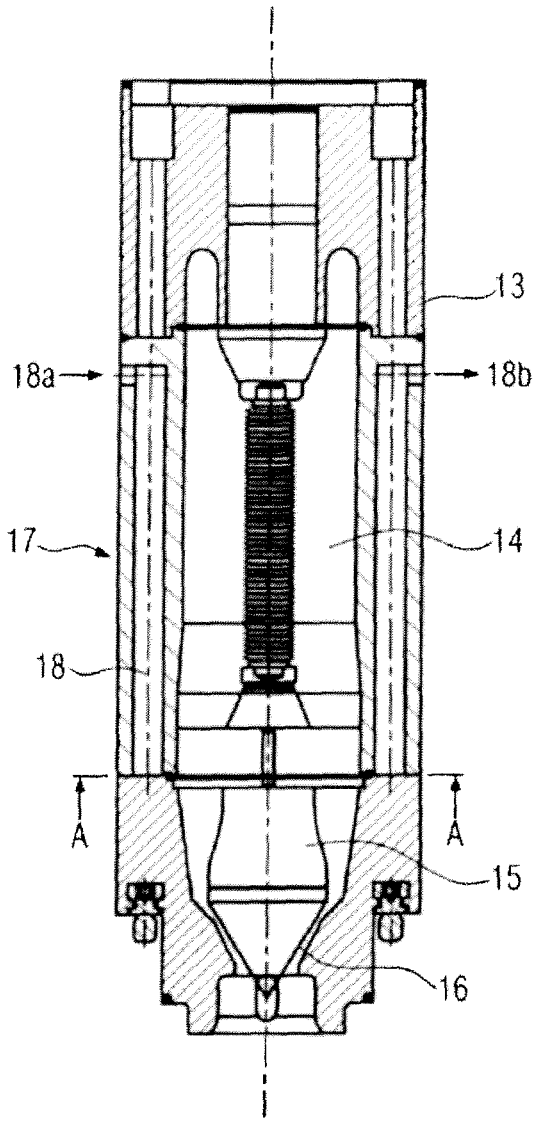
FIG. 3A shows a schematic representation of a filling valve according to the disclosure.
Figure 3B:
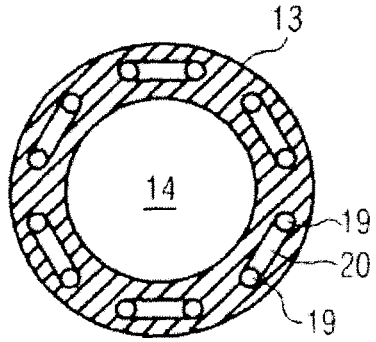
FIG. 3B shows the section A-A of FIG. 3A.

As is shown in FIG. 3A, each filling valve 4 includes a wall 13 which encloses a product chamber 14 in which a valve member 15 moves essentially vertically controlled to open and close a valve opening 16. Such filling valves and their function are well-known. The filling valve 4 according to the disclosure is equipped with a heat exchanger 17 which is preferably integrated in the wall 13 and extends at least over the vertical height of the product chamber 14 from the (non-depicted) inlet of the supply line 7 to just above the valve opening 16. The heat exchanger 17 includes a channel 18 which is included in a circuit of a heat transfer medium via a flow pipe 18*a* and a return pipe 18*b*. Here, the flow 18*a* and the return 18*b* are preferably connected to the cooling and/or heating set 10 which also supplies the store tank 8. The channel 18 contains, as is shown in FIG. 3B, a plurality of holes or ribs 19 which extend in the axial direction of the wall 13, wherein two adjacent holes or ribs 19 each are connected to each other via grooves 20 alternately at the lower and upper ends to the channel 18 passing through.

With the embodiment according to the disclosure, the heat exchangers 9 and 17, respectively, can be supplied with a coolant, for example glycol, by the store tank 8 and the filling valve 4 if these plant parts are to be quickly brought to the filling temperature again after hot sterilization. In return, the heat exchangers 9 and 17, respectively, can be supplied with a heating medium, such as for example steam or hot water, if the point is to overcome a temporary interruption of operation without the product losing its filling temperature or having to be circulated in the circuit in a time-consuming manner which is not gentle on the product, this being important, for example, in case of hot filling.

In variation to the described and drawn embodiment, it is also possible to only provide the store tank or only the filling valve with the heat exchanger. Moreover, other plant parts, in particular those being in contact with the product, can be provided with integrated heat exchangers. The constructive embodiment of the heat exchangers can be modified and adapted to the particular construction of the components to be provided therewith. Cooling and heating can be accomplished by separate sets.

The invention claimed is:

1. Filling device for beverages, comprising a store tank for receiving a beverage supply, a filling valve for filling packages with the beverage from the store tank, and a heat exchanger integrated in a wall of the store tank and in a wall of the filling valve, wherein the filling valve includes a channel integrated in the wall through which a heat transfer medium flows, whereby the channel contains a plurality of holes which extend in the axial direction of the wall.

2. Filling device according to claim 1, wherein the store tank has a double-walled design with an internal and an external wall between which a heat transfer medium flows.

3. Filling device according to claim 2, wherein all external walls of the store tank have a double-walled design.

4. Filling device according to claim 1, wherein the store tank is connected to at least one of a cooling set and a heating set.

5. Filling device according to claim 1, and wherein in a filling carousel the store tank is arranged symmetrically to an axis of revolution on a carrier of the carousel.

6. Filling device according to claim 4, wherein at least one of the cooling and the heating set is arranged on the store tank.

7. Filling device according to claim 5, wherein at least one of the cooling set and the heating set is arranged symmetrically to the axis of revolution of the filling carousel.

8. Filling device according to claim 4, wherein at least one of the cooling set and the heating set is placed next to the filling device and connected to the store tank via one of medium supplies rotary distributors, or a combination thereof.

9. Filling device according to claim 4, wherein the heat exchanger of the filling valve is connected to at least one of the cooling set and the heating set connected to the store tank.

10. Filling device according to claim 1, wherein the channel extends in the direction of the height of a product chamber of the filling valve.

11. Filling device for beverages, comprising a store tank for receiving a beverage supply, a filling valve for filling packages with the beverage from the store tank, and a heat exchanger integrated in a wall of the filling valve, wherein the filling valve includes a channel integrated in the wall through which a heat transfer medium flows, whereby the channel contains a plurality of holes which extend in the axial direction of the wall.

12. Filling device according to claim 11, wherein the channel extends in the direction of the height of a product chamber of the filling valve.

* * * * *